US008628064B2

(12) United States Patent
Wu

(10) Patent No.: US 8,628,064 B2
(45) Date of Patent: Jan. 14, 2014

(54) MULTI-SECTION PULLING ROD STRUCTURE

(76) Inventor: Chen-Chuan Wu, Hsin Chuang (TW)

( * ) Notice: Subject to any disclaimer, the term of this patent is extended or adjusted under 35 U.S.C. 154(b) by 57 days.

(21) Appl. No.: 13/474,331

(22) Filed: May 17, 2012

(65) Prior Publication Data

US 2013/0119328 A1 May 16, 2013

(30) Foreign Application Priority Data

Nov. 15, 2011 (TW) ..... 100221543 U

(51) Int. Cl.
*B66F 3/00* (2006.01)

(52) U.S. Cl.
USPC ..... 254/134; 254/133 R; 248/125.8; 248/354.2

(58) Field of Classification Search
USPC ..... 254/133 R, 134; 248/125.8, 354.3
See application file for complete search history.

(56) References Cited

U.S. PATENT DOCUMENTS 4,918,896 A * 4/1990 Wiese ..... 52/632
6,698,698 B1 * 3/2004 Hsieh ..... 248/125.8

* cited by examiner

*Primary Examiner* — Lee D Wilson
*Assistant Examiner* — Shantese McDonald
(74) *Attorney, Agent, or Firm* — Muncy, Geissler, Olds & Lowe, PLLC

(57) ABSTRACT

A multi-section pulling rod structure, comprising: a retractable pulling rod, a positioning piece, and a plug set. The retractable pulling rod includes a first socket, a second socket, and at least a third socket, sleeved and fixed onto each other through their ends of small diameters, with their bottom ends provided respectively with a first plug, a second plug, and at least a third plug. Positioning piece is disposed inside second socket, and a plurality of positioning holes are provided on positioning piece. A press rod controls action of first plug, and at the same time brings second plug and third plug into action, so as to make steel beads on each plug to position in or detach from holes of each socket, and control steel bead of second plug to position in one of selected positioning holes on positioning piece, hereby reaching the extended height with minute adjustments.

8 Claims, 6 Drawing Sheets

MULTI-SECTION PULLING ROD STRUCTURE

BACKGROUND OF THE INVENTION

1. Field of the Invention

The present invention relates to a multi-section pulling rod structure, and in particular to a retractable and adjustable multi-section pulling rod structure.

2. The Prior Arts

In general, the retractable pulling rod is utilized on a luggage trunk, and usually, the retractable pulling rod used most frequently is made of a plurality of sockets, the number of sockets utilized depends on user's requirement. Since the length of each socket is fixed, so that in actual application, when the sockets of a pulling rod are fully extended or retracted, it is either too long or too short, thus causing inconvenience.

In order to overcome the shortcomings mentioned above, a minutely adjustable and positioning retractable pulling rod is proposed as shown in FIG. 1. Wherein, the retractable pulling rod structure includes: a parent tube 10, a child tube 12, and a positioning device 14. The positioning device 14 is disposed at one end of the child tube 12, and is composed of a sleeve base 16, an action element 18, a compression spring 20, and a positioning bead column 22. The top surface of the sleeve base 16 is connected to the action element 18, with its lower end provided with an action plate 182. The compression spring 20 is sleeved around a blocking portion 184 on the upper end of the action plate 182. The positioning bead column 22 is provided at the lower end of the action plate 182, so that a slide column 24 can be inserted from a side of the positioning bead column 22 to a slant slot hole 186 at the lower end of the action plate 182. The sleeve base 16 is provided with a slide guidance hole 162, which corresponds to a through hole 122 of the child tube 12, for the positioning bead column 22 to move therein. An action rod 26 is used to control the action of the positioning device 14. When the action rod 26 presses the action element 18 downward, the action plate 182 is brought to move downward, so that the compression spring 20 is compressed. Meanwhile, the slide column 24 is moved upward along a slant slot hole 186 on the action plate 182, so as to make the positioning bead column 22 to retract inward, to detach from a row of holes 102 of the patent tube 10. As such, the child tube 12 can be pulled and retracted freely in the parent tube 10. Similarly, in case that the action rod 26 is pulled to a predetermined length, and then it is released, thus the action element 18 is returned to its original position through the pressing upward of the compression spring 20. Meanwhile, the slide column 24 is moved downward along the slant slot hole 186 on the action plate 182, so as to make the positioning bead column 22 to extend outward, to insert into the row of holes 102 in the parent tube 10, in achieving extension or retraction of the pulling rod.

Though the pulling rod mentioned above can be positioned and adjusted according to the user's requirement, yet it still has the following drawbacks;

1. Since a row of holes are disposed on the parent tube, a multi-section retractable pulling rod can not be realized, so it has limitations in practical applications.

2. Since a plurality of holes (row of holes) are placed onto the parent tube (outer tube) for the child tube (inner tube) to be adjusted to extend or retract by means of the positioning bead column, therefore, its outer appearance is not aesthetically pleasing. Moreover, since dust and particles tend to get inside and gather in the tube through the holes, that could cause difficulty in extending and retracting the child tube along the parent tube. Also, its is rather difficult to remove the dust and particles from the tube in causing quite inconvenience.

Therefore, presently, the design and performance of the retractable pulling rod of the prior art is not quite satisfactory, and it has much room for improvements.

SUMMARY OF THE INVENTION

In view of the problems and shortcomings of the prior art, A major objective of the present invention is to provide a multi-section pulling rod structure having a plurality of retractable sockets. Wherein, inside the second socket is provided with a positioning piece having a plurality of positioning holes, so a user may make minute adjustments of the positions of the socket, to achieve the length desired by a user.

Another objective of the present invention is to provide a multi-section pulling rod structure, for which a positioning piece having a plurality of positioning holes is placed in the second socket, so that the positioning pieces having different numbers of positioning holes and different spacings can be designed and utilized based on actual requirement, so as to solve the shortcomings of the prior art that, holes are disposed on the outer tube in causing problems of unpleasing outer appearance, difficult to clean the dust gathered inside, and limited applications.

In order to achieve the above-mentioned objective, the present invention provide a multi-section pulling rod structure, comprising: a retractable pulling rod, a positioning piece, and a plug set. The pulling rod includes a first socket, a second socket, and at least a third socket, sleeved and fixed onto each other through their ends of small diameters. The second and third sockets are provided each with at least a hole, for fixing and detaching each socket. Inside the second socket is provided with a dovetail groove, and a positioning piece is provided in the second socket. Wherein, the positioning piece is provided with a plurality of positioning holes spaced apart and a dovetail tenon, so that it can be put and fixed into the corresponding dovetail groove. The plug set includes a first plug, a second plug, and at least a third plug, disposed respectively at the bottom ends of the corresponding first socket, the second socket, and the third socket. At least a connection piece and at least a steel bead are provided for the respective first plug, second plug, and third plug, so that a press rod controls the movement of the connection piece of the first plug, to connect the steel bead to position into at least a positioning hole of the positioning piece, for adjusting positions of the first socket and the second socket. Or, alternatively, the press rod controls the connection pieces of the first plug, second plug, and third plug to move, to connect at the same time the steel bead to position in or detach from the holes on each of the socket, to make the pulling rod extend or retract.

Further scope of the applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The related drawings in connection with the detailed description of the present invention to be made later are described briefly as follows, in which.

DETAILED DESCRIPTION OF THE PREFERRED EMBODIMENT

The purpose, construction, features, functions and advantages of the present invention can be appreciated and understood more thoroughly through the following detailed description with reference to the attached drawings. And, in the following, various embodiments are described in explaining the technical characteristics of the present invention.

The multi-section pulling rod structure of the present invention is suitable for use on a luggage trunk. In application, the retractable pulling rod is pulled up to a certain height to facilitate pulling and dragging the luggage trunk. Then, upon finishing using the pulling rod, it is released from positioning, to be pushed down to reduce its height and volume occupied. Through long term observations, it is found that, in application, a user tends to pull the multi-section rod to its full length, and then retract it one section, or just use its full length. In adjustment, most of users tend to use the first socket or the second socket to adjust its height, to fit for the height of its user. However, presently, length of the socket is fixed, so in extending or retracting the pulling rod a socket, the height realized may not be suitable for the user, to cause inconvenience in application.

To redress and overcome the shortcomings of the prior art, the present invention provides a multi-section pulling rod structure, that can be adjusted minutely to fit for the height of the user, in achieving convenience in usage.

Figure 1:
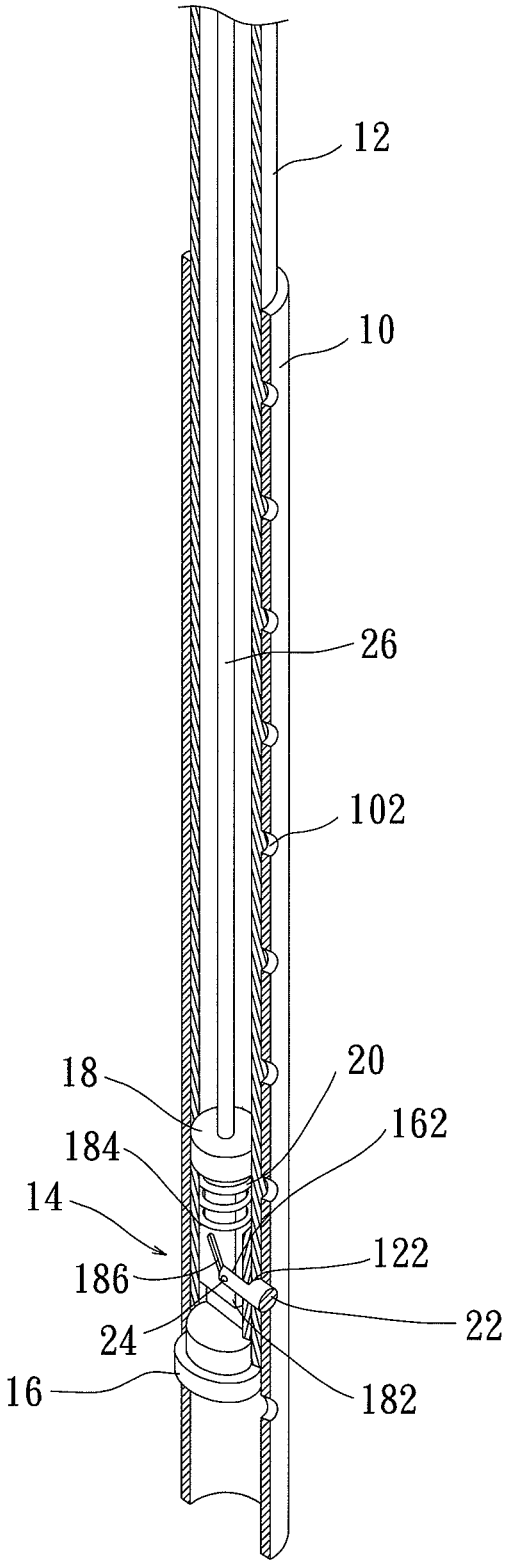
FIG. 1 is a schematic diagram of a retractable pulling rod of the prior art.
Figure 2:
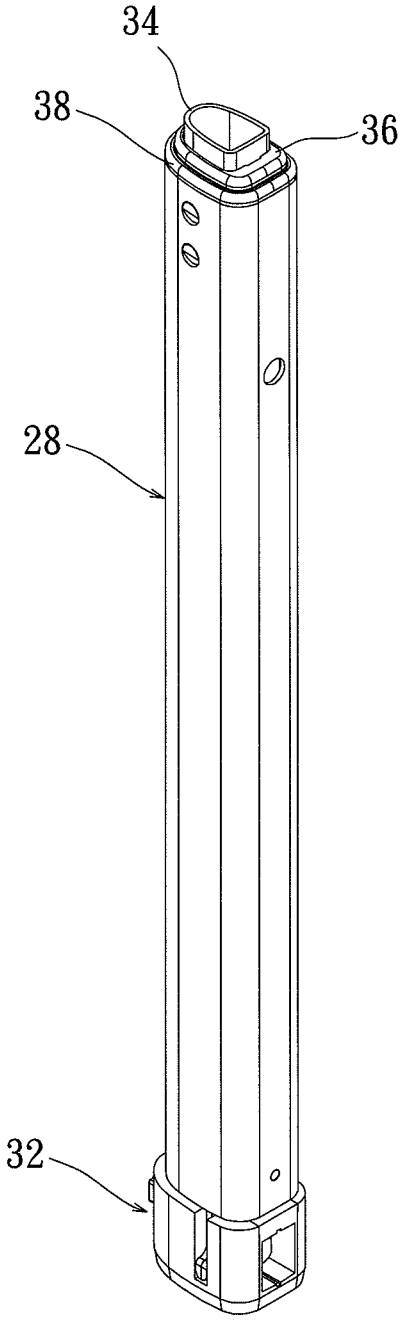
FIG. 2 is a perspective view of a multi-section pulling rod structure according to the present invention.
Figure 3:
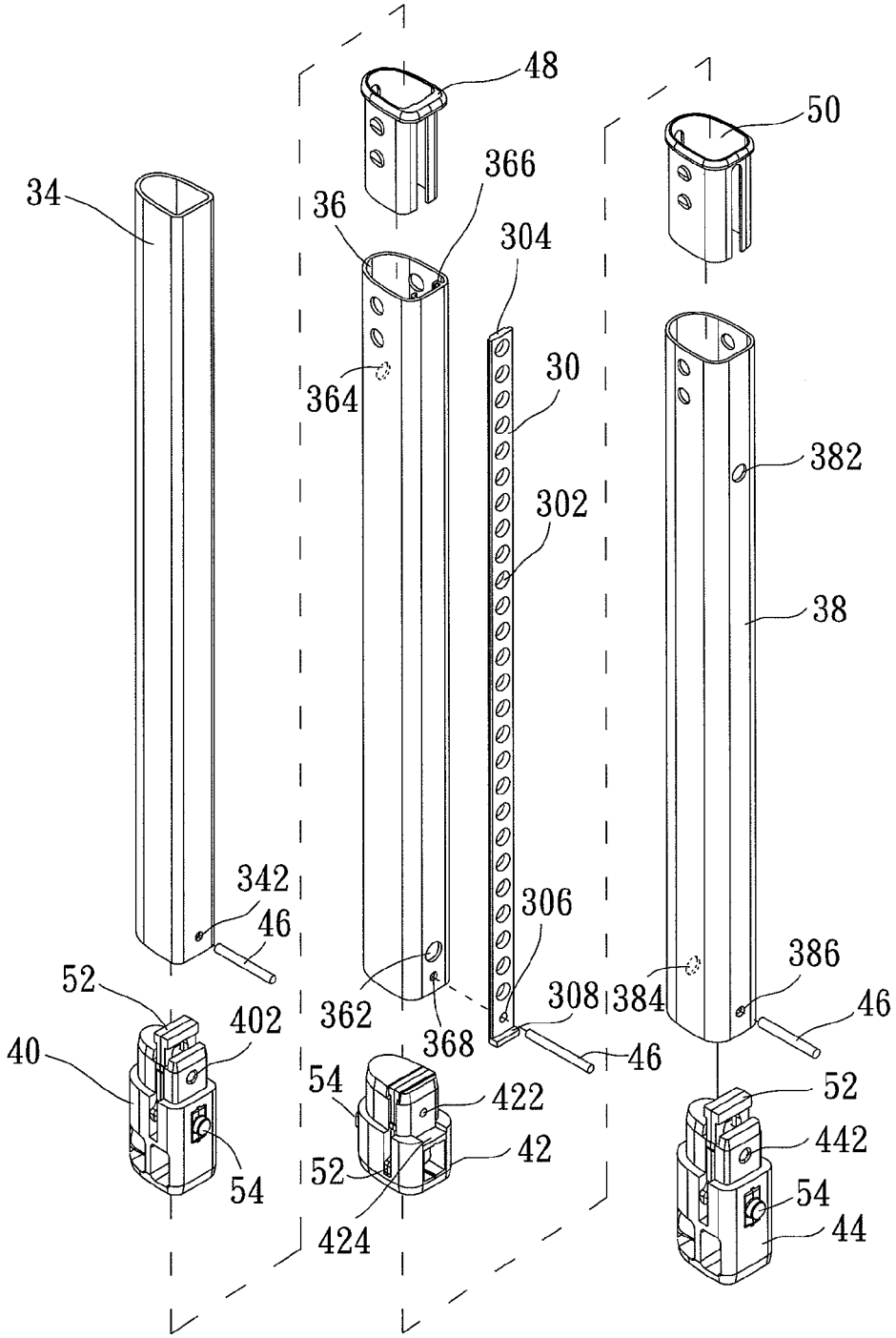
FIG. 3 is an exploded view of a multi-section pulling rod structure according to the present invention.

Refer to FIGS. 2 and 3 respectively for a perspective view of a multi-section pulling rod structure according to the present invention; and an exploded view of a multi-section pulling rod structure according to the present invention. As shown in FIGS. 2 and 3, the multi-section pulling rod structure, comprising: a retractable pulling rod 28, a positioning piece 30, and a plug set 32. Wherein, the retractable pulling rod 28 includes a first socket 34, a second socket 36, and at least a third socket 38, sleeved and fixed onto each other through their ends of small diameters. Herein, a retractable pulling rod made of three sockets is taken as example for explanation. The second sockets 36 and third socket 38 are each provided with at least a hole, in this embodiment, two holes are designed as an extension positioning hole and a retraction positioning hole. Wherein, the second socket 36 and the third socket 38 each includes the first holes 362, 382 as the extension positioning holes, and the second holes 364, 384 as the retraction positioning holes respectively, for fixing and detaching between each socket, that will be described in detail later. Inside the second socket 36 is provided with a dovetail groove 366, that is designed to be a concave of square shape, such that the positioning piece 30 is placed in the second socket 36. Wherein, the positioning piece 30 is provided with a plurality of positioning holes 302 spaced apart, and a dovetail tenon 304, the dovetail tenon 304 is designed to be a convex of square shape, so that it can be placed and fixed in the corresponding dovetail groove 366.

The plug set 32 includes a first plug 40, a second plug 42, and at least a third plug 44, disposed respectively at the bottom ends of the corresponding first socket 34, the second socket 36, and the third socket 38. The first socket 34, the second socket 36, and the third socket 38 are provided respectively with first insertion pin holes 342, 368, 386, correspond respectively to the second insertion holes 402, 422, 442 of the first plug 40, the second plug 42, and the third plug 44. During assembly, an insertion pin 46 is used to penetrate through and fix in the first insertion pin holes 342, 368, 386 and the second insertion pin holes 402, 422,442, so that the first plug 40, the second plug 42, and the third plug 44 are fixed respectively onto the first socket 34, the second socket 36, and the third socket 38.

Since inside the second socket 36 is provided with a positioning piece 30, and the bottom end of the positioning piece 30 is further provided with a third insertion pin hole 306 and a positioning portion 308, such that the third insertion pin hole 306 corresponds to the first insertion pin hole 368 and the second insertion pin hole 422. Therefore, the insertion pin 46 can penetrate through the first insertion pin hole 368, the second insertion pin hole 422, and the third insertion pin hole 306, to make the positioning piece 30 and the second plug 42 fix onto the second socket 36, and the positioning portion 308 fasten and fix into a positioning slot 424 of the second plug 42.

In assembling each socket, a first sleeve 48 and a second sleeve 50 can be provided on the upper ends of the second socket 36 and the third socket 38, so that the first plug 40 of the first socket 34 is pressed against the first sleeve 48 of the second socket 36, and the second plug 42 of the second socket 36 is pressed against the second sleeve 50 of the third socket 38. As such, the connections between the sleeved first socket 34, second socket 36, and the third socket 38 can be fixed and secured, to enhance connection stability.

Figure 4:
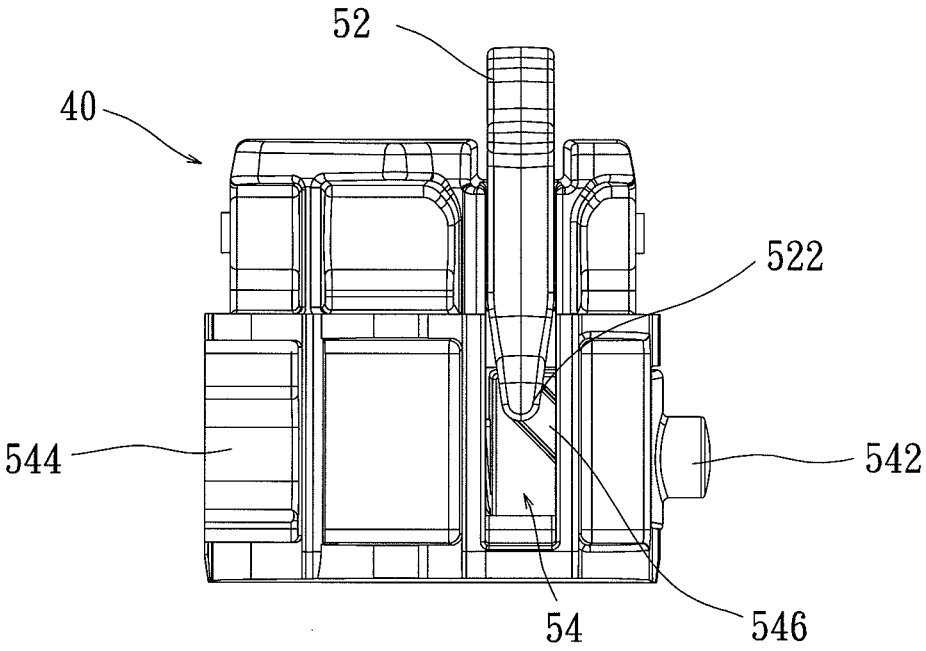
FIG. 4 is a schematic diagram of a plug according to the present invention.

In the descriptions above, the first plug 40, the second plug 42, and the third plug 44 are provided respectively with a connection piece 52, and at least a steel bead 54. Refer to FIG. 4 for a schematic diagram of a plug according to the present invention. Since the structures of the first plug 40, the second plug 42, and the third plug 44 are the same, herein, the structure of the first plug 40 is taken as an example for explanation. At least one side of the steel bead 54 is extended a protrusion portion, so that on two sides of the steel bead 54 are extended respectively with a first protrusion portion 542 and a second protrusion portion 544, to match the positioning holes of the second socket 36 and the third socket 38. The front and back of the steel bead 54 are provided respectively with a corresponding slide slot 546, for positioning of a slide block 522 on both sides of bottom end of the connection piece 52. Through the up-and-down reciprocal movements of the connection piece 52, the slide block 522 is made to move in the slide slot 546, to bring the first protrusion portion 542 to position in or detach from the first hole 382, or to bring the second protrusion portion 544 to position in or detach from the second hole 384.

Figure 5:
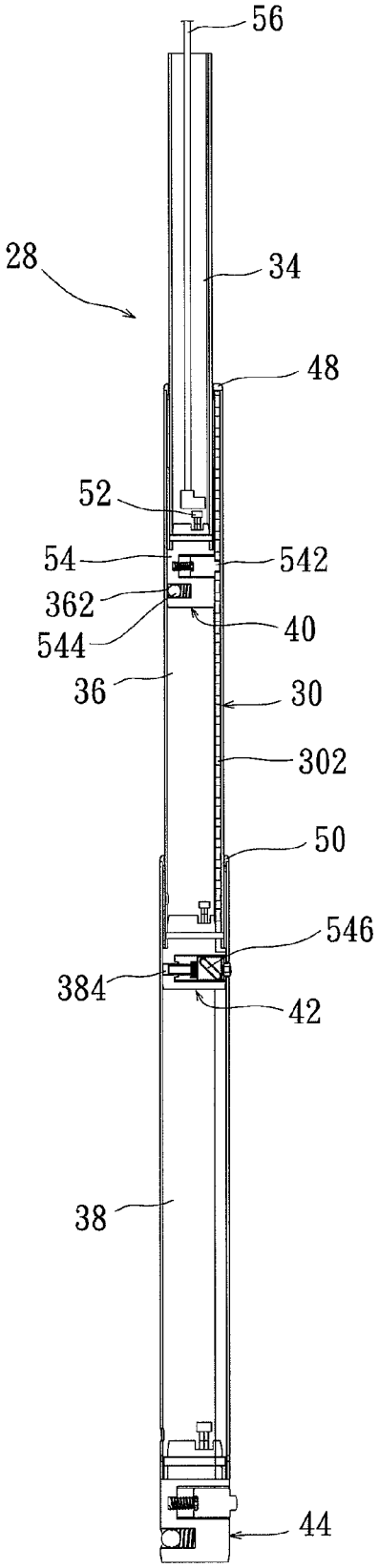
FIG. 5 is a schematic diagram of an extended multi-section pulling rod structure according to the present invention.

To further describe the operation of the present invention, refer to FIG. 5 for a schematic diagram of an extended multi-section pulling rod structure according to the present invention. Firstly, the pulling rod before extension is described. The steel bead 54 of the first plug 40 is positioned in the extraction positioning hole of the second socket 36. In other words, the second protrusion portion 544 of the steel bead 54 is protruded and extended in the second hole 364, so that the first socket 34 is retracted into the second socket 36. Similarly, the steel bead 54 of the second plug 42 is positioned in the retraction positioning hole of the third socket 38. In other words, the second protrusion portion 544 of the steel bead 54 is protruded and extended in the second hole 384, so that the second socket 36 is retracted into the third socket 38.

Subsequently, in order to release each of the socket from the retraction positioning state, a press rod 56 controls the action of the first plug 40, then the first plug 40 will bring the second plug 42 and the third plug 44 into motion at the same time. To be more specific, when the first plug 40 is pressed by the press rod 56, the slide block 522 of the connection piece 52 on the first plug 40 will move downward along the slide slot 546, meanwhile, it will bring the second protrusion portion 544 of the steel bead 54 to retract from the second hole 364 into the second socket 36, to release it from the positioning state, so that the first socket 34 can move freely in the second socket 36. Moreover, when the first plug 40 is moved downward, it will press against the second plug 42, to make the slide block 522 of the connection piece 52 to move downward along the slide slot 546, meanwhile, it will bring the second protrusion portion 544 of the steel bead 54 to retract from the second hole 384 into the third socket 38, to release it from the positioning state, so that the second socket 36 can move freely in the third socket 38.

In the conditions of various sockets mentioned above, the user may pull the retractable pulling rod 28 upward, to make the second socket 36 move upward, until the second plug 42 presses against the second sleeve 50 of the third socket 38. Meanwhile, the first protrusion portion 542 of the steel bead 54 will extend and fix in the first hole 384 of the third socket 38. As such, the second socket 36 and the third socket 38 may realize and complete the extension of the pulling rod. It is worth to mention that, when a user pulls the first socket 34 up in the second socket 36, he may choose the length of first socket 34 to be pulled up, and after reaching the selected position, he may release the pressing of the press rod 56, so as to actuate the first connection piece 52 of the first plug 40. In other words, the slide block 522 of the first connection piece 52 will move upward along the slide slot 546, meanwhile the first protrusion portion 542 of the connection steel bead 54 will extends into one of the positioning holes 302 on the positioning piece 30, hereby realizing the extension of the first socket 34 from the second socket 36, to add an additional socket to the length of the pulling rod.

In the descriptions mentioned above, the positioning piece 30 is installed in the second socket 36, and the positioning piece 30 can be replaced to have different number of positioning holes 302 and different spacings depending on actual requirements, for the user to make minute adjustment of extension of pulling rod, to solve the problem of the prior art that, the holes on the outer tube is not aesthetically pleasing, the dust gathered inside is difficult to clean, and limitations of its applications.

The operations of the first plug 40 and the second plug 42 are as described above, and the operation of the third plug 44 on the third socket 38 is similar. Therefore, more sockets can be added to meet the user's requirements.

Figure 6:
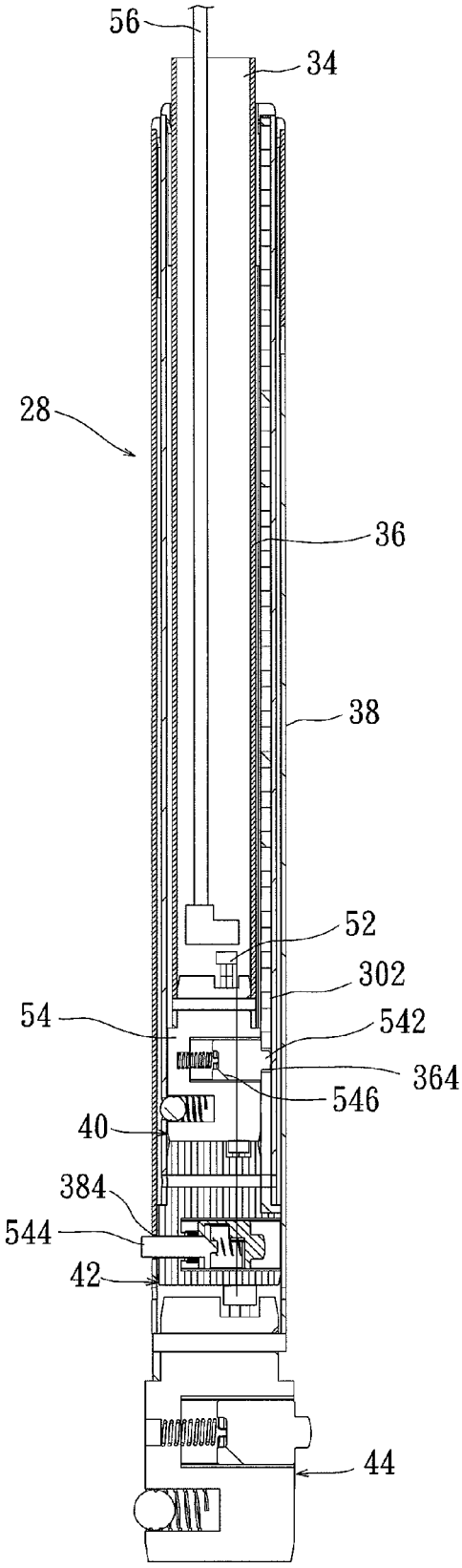
FIG. 6 is a schematic diagram of a retracted multi-section pulling rod structure according to the present invention.

Finally, refer to FIG. 6 for a schematic diagram of a retracted multi-section pulling rod structure according to the present invention. As shown in FIG. 6, the press rod 56 controls the actions of the first plug 40, and the first plug 40 may connect at the same time the second plug 42 and the third plug 44 to move. To be more specific, when the first plug 40 is pressed by the press rod 56, the slide block (not shown) of the connection piece 52 on the first plug 40 will move downward along the slide slot 546. Meanwhile, the first protrusion portion 542 of the steel bead 54 is retracted from the positioning hole 302 into the second socket 36, so that the first socket 34 may continue to move downward in the second socket 36, until the second protrusion portion 544 of the steel bead 54 extends and fixes in the second hole 364, such that the first socket 34 retracts completely into the second socket 36. Moreover, when the first plug 40 moves downward, it will press the second plug 42, so that the slide block 522 of the connection piece 52 moves downward along the slide slot 546. Meanwhile, the first protrusion portion 542 of the steel bead 54 is retracted from the first hole 382 into the third socket 38, so that the second socket 34 may continue to move downward in the third socket 38, until the second protrusion portion 544 of the steel bead 54 extends and fixes in the second hole 384, such that the second socket 36 retracts completely into the third socket 38, as such, retracting the first socket 34 and the second socket 36 into the third socket 38, in achieving minimum size multi-section pulling rod.

Summing up the above, the present invention is simple in construction, easy in operation. During operation, it only requires to press the press rod, to control the connections between the first plug, the second plug, and the third plug, to make the pulling rod extend and retract, in achieving convenient operations. Furthermore, through the minute adjustment of length between the first socket and the second socket to match the height of the user, to solve the problem of the prior art of height difference of pulling rod and user, and provide convenience of easy and handy operation, thus having wide applications in Industry.

The above detailed description of the preferred embodiment is intended to describe more clearly the characteristics and spirit of the present invention. However, the preferred embodiments disclosed above are not intended to be any restrictions to the scope of the present invention. Conversely, its purpose is to include the various changes and equivalent arrangements which are within the scope of the appended claims.

What is claimed is:

1. A multi-section pulling rod structure, comprising:

a retractable pulling rod, includes a first socket, a second socket, and at least a third socket, sleeved and fixed onto each other through their ends of small diameters, said second and said third sockets are provided each with at least a hole, inside said second socket is provided with a dovetail groove;

a positioning piece, provided in said second socket, said positioning piece is provided with a plurality of positioning holes spaced apart and a dovetail tenon, so that said dovetail tenon is put and fixed into said corresponding dovetail groove; and a plug set, including a first plug, a second plug, and at least a third plug, disposed respectively at the bottom ends of said corresponding first socket, said second socket, and said third socket, at least a connection piece and at least a steel bead are provided for said respective first plug, said second plug, and said third plug, so that a press rod controls movements of said connection piece of said first plug, to connect said steel bead to position into said positioning hole, for adjusting positions of said first socket and said second socket, or said press rod controls movements of said connection pieces of said first plug, said second plug, and said third plug, to connect said steel bead to position in or detach from said holes, to make said retractable pulling rod extend or retract.

2. The multi-section pulling rod structure as claimed in claim 1, wherein said first socket, said second socket, and said third socket are provided each with a first insertion pin hole, corresponds respectively to a second insertion pin hole of said first plug, said second plug, and said third plug, an insertion pin is used to penetrate and fix into said first insertion pin hole and said second insertion pin hole, so that said first plug, said second plug, and said third plug fix onto said corresponding first socket, said second socket, and said third socket.

3. The multi-section pulling rod structure as claimed in claim 2, wherein said positioning piece is further provided with a third insertion pin hole, so that said insertion pin penetrates into said first insertion pin hole, said second insertion pin hole, and said third insertion pin hole, to fix said positioning piece and said second plug onto said second socket.

4. The multi-section pulling rod structure as claimed in claim 1, wherein upper ends of said second socket and said third socket are each provided with a sleeve, to fix said sleeved first socket, said second socket, and said third socket.

5. The multi-section pulling rod structure as claimed in claim 1, wherein said press rod is provided in said first socket, to control movements of said first plug of said first socket.

6. The multi-section pulling rod structure as claimed in claim 1, wherein said second plug is provided with a positioning slot, for fastening and fixing of corresponding positioning portion at bottom end of said positioning piece.

7. The multi-section pulling rod structure as claimed in claim 1, wherein said dovetail groove is a concave of square shape, and said dovetail tenon is a convex of square shape, said dovetail tenon is fastened and fixed to said corresponding dovetail groove.

8. The multi-section pulling rod structure as claimed in claim 1, wherein at least a side of said steel bead is extended a protrusion portion, and front side and back side of said steel bead is provided with a corresponding slide slot, for positioning of a slide block at two sides of bottom end of said connection piece, when said connection piece is moved downward, said slide block is made to move in said slide slot, to bring said protrusion portion to position in or detach from said hole.

* * * * *